United States Patent [19]

Abt et al.

[11] 4,417,675

[45] Nov. 29, 1983

[54] MELTING AND APPLICATION DEVICE FOR MELTING ADHESIVES

[75] Inventors: Anton Abt, Oberboihingen; Alfred Dettelbach, Stuttgart; Gerhard Gresser, Oberboihingen, all of Fed. Rep. of Germany

[73] Assignee: Reich Spezialmaschinen GmbH, Nuertingen, Fed. Rep. of Germany

[21] Appl. No.: 236,678

[22] Filed: Feb. 23, 1981

[30] Foreign Application Priority Data

Mar. 7, 1980 [DE] Fed. Rep. of Germany ..... 3008779

[51] Int. Cl.[3] ..... B67D 5/62; F27B 14/00

[52] U.S. Cl. ..... 222/146 HE; 219/421

[58] Field of Search ..... 222/146 H, 146 HE; 219/421, 230; 118/202; 425/143, 144

[56] References Cited

U.S. PATENT DOCUMENTS 3,352,279 11/1967 Lockwood ..... 118/202 X
3,389,684 6/1968 Talbot ..... 118/202
3,877,610 4/1975 Dickey ..... 222/146 HE
4,178,876 12/1979 Nicklas et al. ..... 222/146 HE X
4,219,728 8/1980 Mercer ..... 118/202 X

FOREIGN PATENT DOCUMENTS 2731799 7/1977 Fed. Rep. of Germany .

*Primary Examiner*—F. J. Bartuska
*Attorney, Agent, or Firm*—W. G. Fasse; D. H. Kane, Jr.

[57] ABSTRACT

Apparatus for melting and applying meltable adhesive in which a separate melting insert including a melting wall is interposed between the melting chamber and the application device. The melting wall is formed with projections or cones, and channels for passing molten adhesive to the nozzle body of the application device. A piston in the melting chamber presses a unit of adhesive against the melting wall. The melting wall is independently heated by a heater and controlling temperature sensor. The nozzle body and melting insert/melting wall are formed of different metallic materials, the latter being made of light metal alloy for better thermal conducting response. The melting insert forming the melting wall is removable to facilitate the cleaning and maintenance.

7 Claims, 4 Drawing Figures

MELTING AND APPLICATION DEVICE FOR MELTING ADHESIVES

CROSS-REFERENCE TO RELATED APPLICATION

The present application relates to German Patent Application No. P 30 08 779.7; filed in the Federal Republic of Germany on Mar. 7, 1980. The priority of said German filing date is hereby claimed.

BACKGROUND OF THE INVENTION

The present invention relates to an apparatus for melting and applying so called melting adhesives, for example in an edge gluing machine.

A melting and application device of the type mentioned above is known from the German Patent Publication (DE-OS) No. 2,731,799 in connection with an edge gluing machine. This German reference corresponds to U.S. Pat. No. 4,178,876, issued on Dec. 18, 1979. In the known device the melting wall is connected as an integral part with the application device. The heat reaches the melting wall from heating elements in the nozzle body of the application device. The melting wall is provided with concentric ring grooves and the molten melting adhesive is applied from the melting wall to the application device through exit openings arranged on one side.

Such a device may, however, lead to the undesirable result that the molten melting adhesive is not always uniformly supplied. Nor is it possible to supply the maximum yield of melted adhesive to the application device. It is also preferable that the melting wall temperature be adapted to the different types of melting adhesive. On the other hand, the application device itself should have a temperature which remains uniform and which generally differs from the melting temperature.

OBJECTS OF THE INVENTION

In view of the above, it is the aim of the invention to achieve the following objects singly or in combination:

to provide a melting and application device for melting adhesives, the temperature of which may be optimally adjusted to different types of melting adhesives and to different operating conditions;

to provide an adhesive melting application device which makes it possible to achieve a uniform and as high as possible conveyance and yield of the molten melting adhesive; and

SUMMARY OF THE INVENTION

According to the invention, this objective is achieved by providing a melting insert arranged between the melting chamber and the application device. The insert is constructed to include the melting wall. Thus, it is possible to heat the application device and the melting wall to different temperatures so that an optimal adaptation to the given operating conditions is possible.

The melting insert is made according to the invention of a material having a high heat conductivity such as, for example, a light metal alloy. The heat of the heating element or means is therefore transmitted especially quickly to the melting adhesive. This is advantageously effective especially when starting the operation of the edge gluing machine because the heating up time for the novel melting insert prior to the start of the edge gluing machine is very short. Yet, on the other hand, it is possible to make the application device of a metallic material having a high material strength to achieve a long operational life for the application device. However, since these metallic materials having a high material strength are poor heat conductors, their use for the melting insert would substantially increase the times for the heat-up and for the cooling down. A feature of the invention is therefore the use of different materials for the application device and for the melting insert. This corresponds in an advantageous manner to the mechanical as well as to the thermal technical requirement of the entire apparatus.

The invention also provides the melting wall with melting cones into which channels extend connecting the melting chamber with a storage chamber arranged between the melting insert and the application device. The invention achieves the advantage that the melting adhesive is melted uniformly and supplied in a central manner into the storage chamber. This feature substantially improves the capacity of the edge gluing machine.

According to another aspect of the invention, a supply channel for the melting adhesive extends from the storage chamber to the application device so that the supply channel merges into the lower zone of the storage chamber. This assures that the formation of a stationary layer of molten adhesive in the lower zone of the storage chamber is avoided and further assures a continuous flow of the molten melting adhesive to the application device. A certain temperature control for the melting insert is assured, because the temperature sensor for controlling the heating device for the melting insert is also arranged in the lower zone of the storage chamber. However, this temperature sensor is influenced not only by the temperature of the molten melting adhesive, but also by the temperature of the melting insert or of the melting wall. Thus, an optimal control characteristic for the melt off temperature of the melting wall is formed from these two temperature values.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
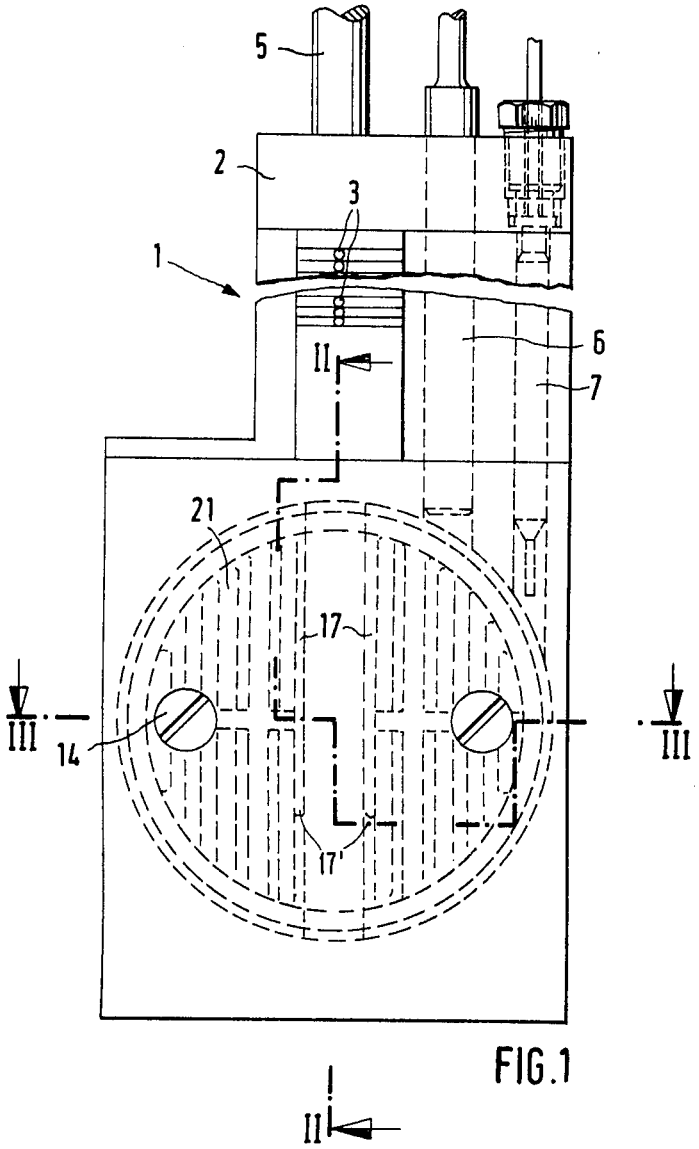
FIG. 1 shows a front view of a melting and application device.

FIG. 1 shows an application device 1 as it is used for the application of liquid melting adhesive onto the lateral narrow surface of a plate-type work piece. The application device 1 is used in connection with an edge gluing machine not shown. For this purpose a wedge-shaped nozzle body (2) is provided with application bores (3) which merge into a supply channel (4) (see also FIG. 2). The application of melting adhesive is controlled in a known manner by means of a rotary slider (5). The heating of the nozzle body (2) is accomplished by a heating element (6), the temperature of which is controlled by a temperature sensor (7).

Figure 2:
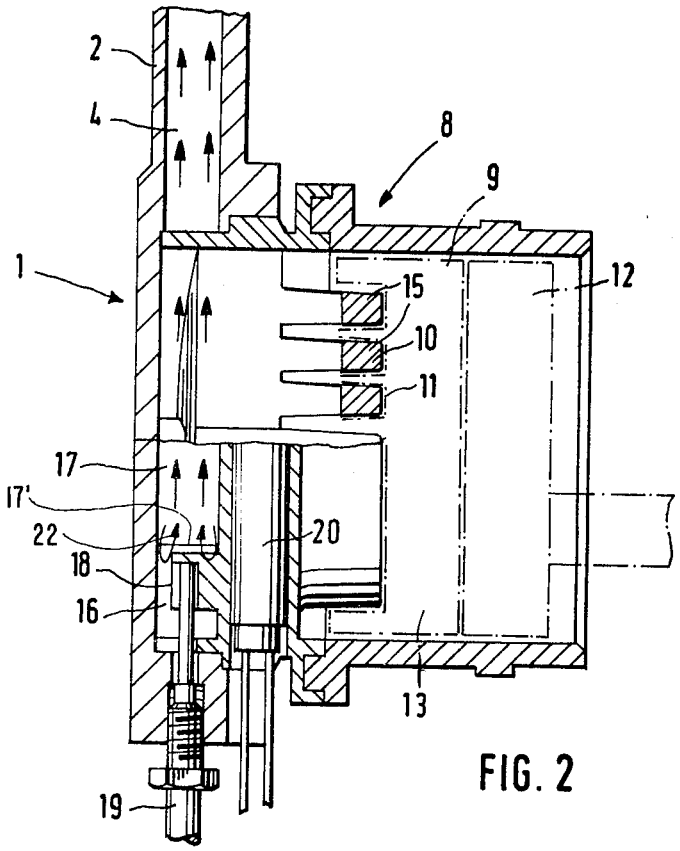
FIG. 2 shows a section along line II—II in FIG. 1.

A melting device (8) is connected with the application device (1) (FIG. 2). Substantially the melting device comprises a melting chamber (9) and a melting insert (10) which closes the melting chamber (9) with its melting wall (11). The melting adhesive unit (13) is pressed against the melting wall (11) by means of a feed advance piston (12).

Figure 3:
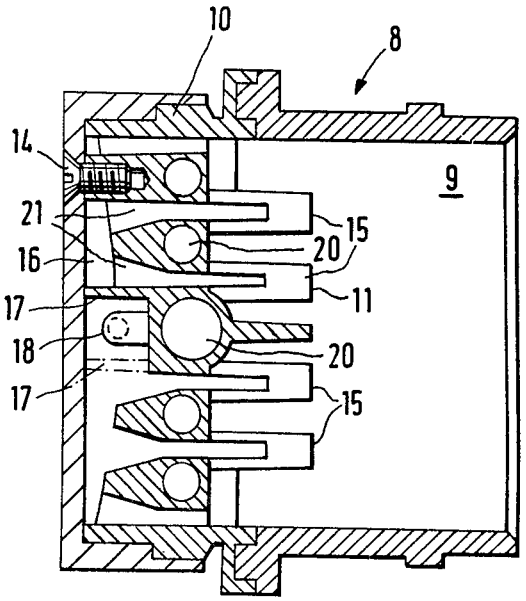
FIG. 3 shows a section along line III—III in FIG. 1.

The cylindrical melting insert (10) is secured to the nozzle body (2) of the application device (1) by means of screws (14) (FIGS. 1 and 3). The melting wall (11) facing the melting chamber (9) is formed by melting cones (15), (see also FIG. 4), which are uniformly and symmetrically distributed over the cross-sectional surface area of the melting wall (11). On the opposite side the melting insert (10) is vaulted concavely so that a storage chamber (16) is formed. This storage chamber (16) is subdivided in its center by two spaced vertical lands (17) which start at the upper end of the storage chamber (16) in alignment with the supply channel (4) to form an extension of the channel (4). The lands (17) of the storage chamber so that adhesive must pass around the lower edges (17') of the lands (17) as indicated by the arrows (22), thereby avoiding a dead space in the adhesive path from channel openings (21) through the storage chamber (16) into the extension of the channel (4). A projection (18) of the melting insert (10) is arranged in this lower zone of the storage chamber (16). The temperature sensor (19) is connected to a heat conducting manner with the projection (18). This temperature sensor (19) influences the heating elements (20) serving for heating the melting insert (10). The sensor is made of a light metal alloy, the heat of the heating elements (20) is quickly conducted to the melting wall (11).

Beginning at the storage chamber (16) vertical channel openings (21) pass through the melting wall (11) of the melting channel insert (10). The openings (21) extend partially into the melting cones (15). They thus connect the melting chamber (9) with the storage chamber (16).

In operation of the melting and application device, the portion of the melting adhesive unit (13) abutting against the heated melting wall (11) is melted and the molten melting adhesive is pressed under the effect of the feeder advance piston (12) through the channel openings (21) into the storage chamber (16). From there the molten adhesive enters from below between the lands into the supply channel (4) and further on through the application bores (3) into the lateral narrow surface of the work piece.

In the present example embodiment the application of the melting adhesive takes place by means of a wedge-shaped nozzle body. However, the application may also take place by means of an adhesive roller to which the molten adhesive is supplied, as described through the supply channels (4).

Further, there is the possibility of using the melting device according to the invention together with known application pistols for melting adhesive as they are used particularly in connection with the manufacture of furniture.

Although the invention has been described with reference to specific example embodiments, it will be appreciated, that it is intended, to cover all modifications and equivalents within the scope of the appended claims.

What is claimed is:

1. An apparatus for melting and applying meltable adhesives, comprising an application device (1) for delivering melted adhesive to a work piece, melting chamber means (9) located adjacent to said application device, melting insert means (10) comprising heatable melting wall means (11) arranged for insertion between and removal from between the melting chamber means (9) and the application device (1), said heatable melting wall means (11) having channel openings (21) therethrough, and feed piston means (12) operatively located for displacement in said melting chamber means, said feed piston means being constructed and arranged for pressing meltable adhesive against the melting wall means, whereby the meltable adhesive is at least partially melted and supplied under pressure to the application device, said apparatus further comprising a storage chamber (16) for storing melting adhesive, said storage chamber being operatively arranged between the melting insert means (10) and the application device (1), said channel openings (21) connecting said storage chamber (16) through the melting wall means (11) with the melting chamber (9) for transporting melted adhesive into said storage chamber, said apparatus further comprising adhesive supply channel means (4) formed between the storage chamber (16) and the application device (1), said supply channel means (4) comprising lands (17) which extend said supply channel means into the lower portion of the storage chamber, said lands (17) being slightly spaced from the lower end of the storage chamber means (16) for assuring the transfer of all adhesive in the storage chamber into the application device by avoiding a dead space in the adhesive path from said channel openings (21) to said supply channel means (4).

2. The apparatus of claim 1, wherein said melting insert means (1) comprises heating means (20) which are independent of any heating means which may be provided for the application device means (1).

3. The apparatus of claim 1, wherein said application device comprises nozzle body means (2), and wherein the nozzle body means (2) and the melting insert means (10) comprise respectively different metallic materials.

4. The apparatus of claim 3, wherein said melting insert means (10) and melting wall means (11) are formed of a light metal alloy.

5. The apparatus of claim 1 or 3, wherein said melting insert means (10) comprises melting cones or projections (15) formed at the melting wall means (11), said channel openings (21) extending into said cones or projections (15).

6. The apparatus of claim 1, further comprising heating means (20) mounted in operative relationship with said melting insert means (10) for independently heating said melting insert means, said melting insert means comprising a projection (18) extending into the lower portion of said storage chamber (16), and temperature sensor means (19) mounted in heat conducting relationship with said melting insert means, said temperature sensor means having an output operatively coupled for controlling the heating means (20) for said melting insert means.

Figure 4:
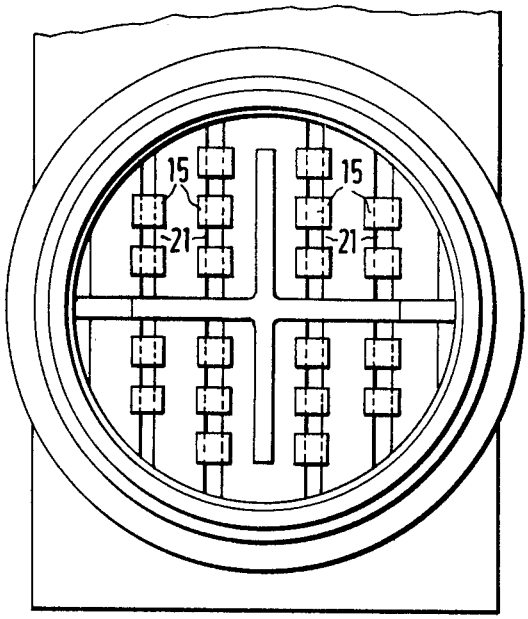
FIG. 4 shows a rear view of the melting device.

7. The apparatus of claim 1, wherein said melting insert means comprises melting cones (15) formed in the melting wall means (11), said melting cones (15) being uniformly and symmetrically distributed over the cross-sectional area of the melting wall (11), said channel openings (21) extending partially into said melting cones (15) also in a uniform and symmetrical distribution (FIG. 4).

* * * * *